US006124771A

United States Patent [19]

Kim et al.

[11] Patent Number: 6,124,771

[45] Date of Patent: Sep. 26, 2000

[54] SWITCH WITH A ROCKER, WHICH HAS AN AFFIXED MAGNET

[75] Inventors: Duk Yong Kim, Suwon; Dong Hwi Lee, Hwasung-Kun, both of Rep. of Korea

[73] Assignee: KMW Co. Ltd., Hwasung, Rep. of Korea

[21] Appl. No.: 09/273,360

[22] Filed: Mar. 22, 1999

[30] Foreign Application Priority Data

Mar. 31, 1998 [KR] Rep. of Korea ..... 11377-98

[51] Int. Cl.[7] ..... H01H 53/00

[52] U.S. Cl. ..... 335/4; 335/5; 335/78; 335/80; 335/181; 335/179; 333/105

[58] Field of Search ..... 335/4, 5, 78–86, 335/128, 179, 181, 276; 333/105

[56] References Cited

U.S. PATENT DOCUMENTS 4,496,919 1/1985 Fournier et al. ..... 335/5

*Primary Examiner*—Lincoln Donovan
*Assistant Examiner*—Raymond Barrera
*Attorney, Agent, or Firm*—Oliff & Berridge, Plc

[57] ABSTRACT

The present invention relates to a switch with a rocker, which has an affixed magnet, capable of being reliably opened or closed by a mechanical operation of a magnetized rocker. The present invention comprises of a supporting plate and a plurality of electromagnets occurring a magnetic force when a power is supplied thereto and being disposed in a bottom surface of the supporting plate. Further, the present invention has a rocker made of a magnetic substance, magnetized in order to occur repulsion with the electromagnet and then rotated by a predetermined angle. Furthermore, the present invention at least one magnet for magnetizing the rocker and retaining an inclined state of the rocker by the if occurred attraction with the electromagnet, and being disposed on the rocker. Also, the present invention has a plate spring, to provide a pressure along with the rotation of the rocker, having erect portions on both end portions thereof, in which the erect portions are fixed to the rocker, and a contact means to contact with connectors by the pressure of the plate spring.

9 Claims, 9 Drawing Sheets

SWITCH WITH A ROCKER, WHICH HAS AN AFFIXED MAGNET

BACKGROUND OF THE INVENTION

1. Field of the Invention

The present invention relates to a switch with a magnetized rocker utilized in a part of a super-high frequency system such as an N-way power divider/combiner, a radio frequency transmission line and the like. More particularly, it relates to a switch with a rocker capable of being reliably opened or closed by an electromechanical operation.

2. Description of Related Art

Hereinafter, a conventional switch of prior art will be schematically described, referring to FIGS. 1 and 2.

As shown in FIG. 1, the conventional switch has a supporting plate 23, with a through hole in each corner thereof. A base-cover 26 is located under the supporting plate 23. Three connectors 31 to 33 are located under the base-cover 26. The conventional switch also has a rocker 25, which is made of metal that can be magnetized and disposed on the base-cover 26.

The supporting plate 23 has a first and second solenoids 21 and 22 disposed respectively at both ends of the bottom surface thereof; and a permanent magnet 24 is disposed between the two solenoids 21 and 22. Further, the first and second solenoids 21 and 22 respectively have a first and second bobbin cores 21*a* and 22*a* therein, so that the solenoids 21 and 22 can function as an electromagnet when a power is supplied.

The base-cover 26 has supporting bars 26*a* connected to each through hole of the supporting plate 23 on each corner thereof, and rocker supporting bars 26*b* to support the rocker 25 on both sides of the center portion thereof. Each rocker supporting bar 26*b* has a through hole on upper portion thereof. Therefore, when the rocker 25 is disposed on the base-cover 26, the rocker 25 is supported by a rocker pin 35, which slips into the through hole of the rocker supporting bar 26*b* and the rocker 25. This is to ensure that predetermined space is maintained between the rocker 25 and the solenoids 21 and 22 and between the rocker 25 and the permanent magnet 24.

In this case, the rocker 25 seesaws about the rocker pin 35 by a predetermined angle.

In the conventional switch, the rocker 25 is magnetized by the permanent magnet 24 to cycle in S-N-S pole. That is, when power is supplied to one of the solenoids, the magnetized rocker 25 is tilted by the influence of a magnetic field from the solenoid. Further, the rocker 25 is always pulled in an upward direction by the permanent magnet 24 disposed on the bottom surface of the supporting plate 23.

The rocker 25 has a plate spring 27 disposed on the lower portion thereof. The base-cover 26 has two dielectric pins 28 inserted at both end portions thereof. When the rocker 25 is tilted, each dielectric pin 28 is pushed by the plate spring 27 in a downward direction of the base-cover 26. Each dielectric pin 28 is surrounded by a spring 29. The spring 29 provides a restoring force to the dielectric pin 28, so that the dielectric pin 28 returns to its original position when the pressure by the plate spring 27 is removed. Each dielectric pin 28 has a reed 30, which contacts with two connectors 31 and 32 or 32 and 33 on the lower end portion thereof.

In conjunction to the conventional switch constructed as described above and as shown in FIG. 2, the following explanation applies. When the power is supplied to the first solenoid 21, S pole (South Pole) occurs in the lower portion thereof. At this time, since the left portion of the rocker 25 is an S pole, the first solenoid 21 repels the left portion of the rocker 25 in the downward direction. At the same time, the right portion of the rocker 25 is moved in the upward direction and is contacted with the second solenoid 22. In this case, the left portion of the plate spring 27 pushes the dielectric pin 28, positioned in the left side of the basecover 26, so that the left reed 30 is contacted with the first and second connectors 31 and 32.

On the contrary, if an operator supplies the power to the second solenoid 22, the right portion of the rocker 25 having S pole is moved in an downward direction by the described principle as above. Also, the right portion of the spring plate 27 pushes the dielectric pin 28, so that the right reed 30 is contacted with the second and third connectors 32 and 33. In this case, the restoring force of the spring 29 disconnects the left reed 30 from the first and second connectors 31 and 32.

In both cases, the rocker 25 is always pulled up by the magnetic field of the permanent magnet 24, disposed in the center portion of the supporting plate 23.

Therefore, the conventional switch requires sufficient power to overcome the friction force between the rocker pin and the through hole of the rocker supporting bars when the switch is operated. Further, the movement of the rocker puts stress on the center portion of the plate spring @ (FIG. 2), which has a thickness of 0.1 mm–0.15 mm. When the stress is persistent, there is a problem that fatigue happens in the area @. Furthermore, the contacted portion of the plate spring can be plastic-deformed while the plate spring is pushing one of the dielectric pins for a long time. In this case, the connectors cannot be properly contacted reliably by the reed because the pressure provided by the dielectric pin can be weakened due to the plastic deformation of the plate spring.

SUMMARY OF THE INVENTION

It is, therefore, an object of the present invention, the switch with a rocker, which has an affixed magnet, to solve two issues. One is to minimize unnecessary friction force during the switching operation and thereby increasing the reliability with lower power consumption. The other is to prevent the plastic deformation of the plate spring by attaching the both ends of the plate spring to the bottom side of the rocker.

In order to accomplish the above object, a switch with a rocker, which has an affixed magnet, comprises: a supporting plate; a plurality of electromagnets occurring a magnetic force when a power is supplied thereto, and being disposed on a bottom surface of the supporting plate; a rocker made of a metal that can be magnetized to occur a repulsion with the electromagnet and being seesawed by a predetermined angle; at least one magnetization means for magnetizing the rocker and retaining an inclined state of the rocker by occurring an attraction with one of the electromagnet and being disposed on the rocker; a pressing means, for providing a pressure along with rotation of the rocker, having erect portion on both end portions thereof, in which the erect portions are fixed to the rocker; and a contact means being contacted with connectors by the pressure of the pressing means.

BRIEF DESCRIPTION OF THE ATTACHED DRAWINGS

The advantage of the present invention will become more apparent to those skilled in the art from the following descriptions when read in conjunction with the accompanying drawings.

DETAILED DESCRIPTIONS OF A PREFERRED EMBODIMENT

Figure 1:
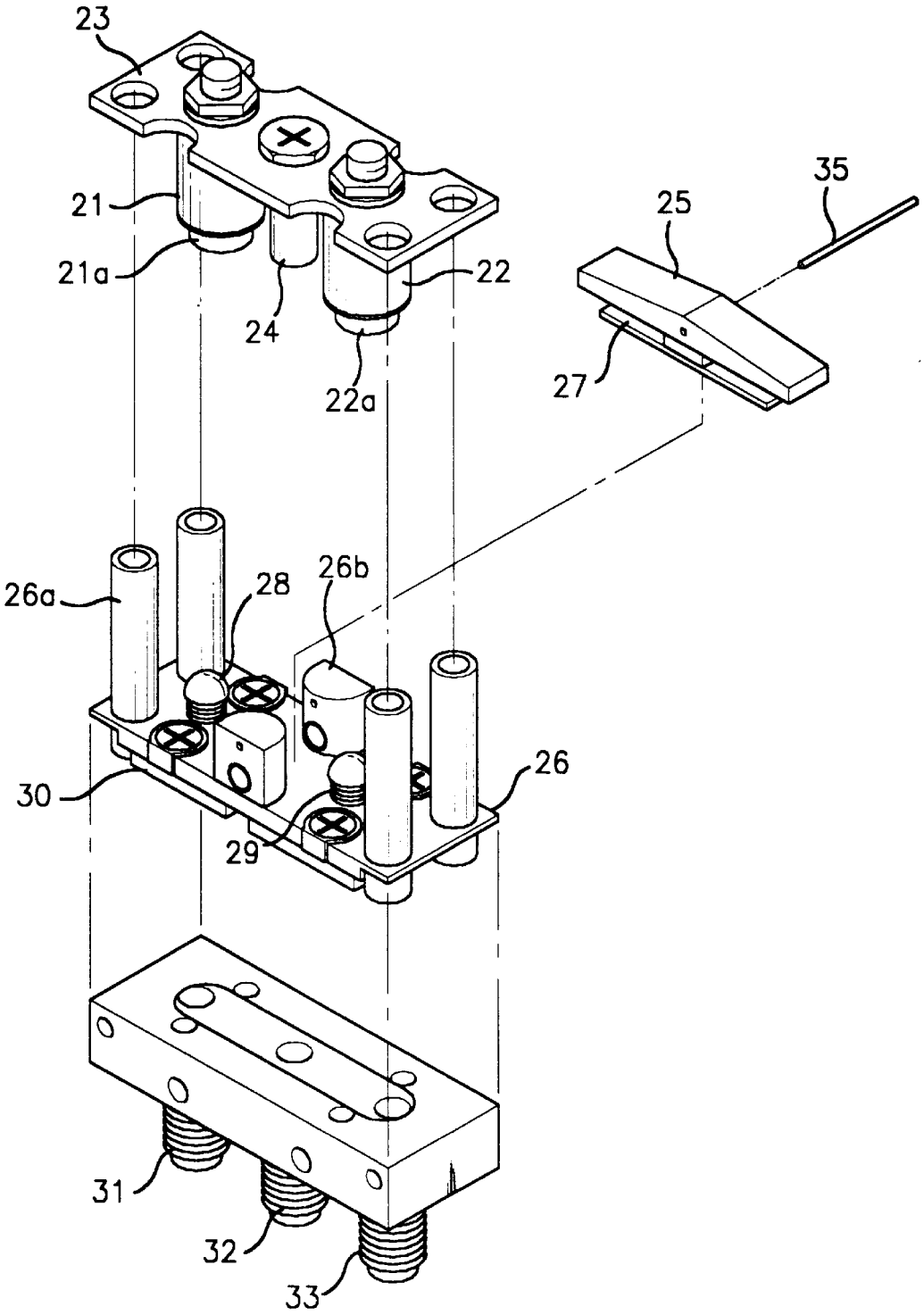
FIG. 1 is a disassembled perspective view showing a switch having a magnetized rocker of the prior art.
Figure 2:
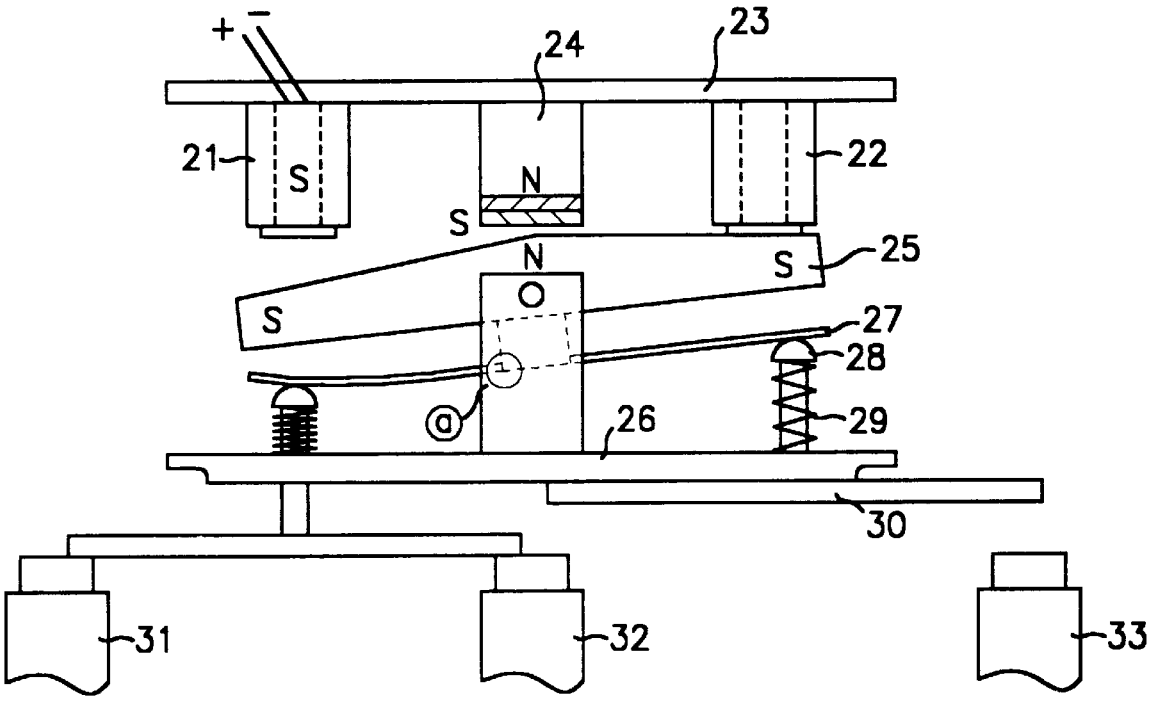
FIG. 2 is a schematic front view showing an operation state of the switch according to the prior art of FIG. 1.

Hereinafter, embodiments of the switch according to the present invention capable of reliably performing a switching operation with lower power consumption and preventing the plastic deformation of the plate spring will be described in detail, referring to the drawings.

Figure 3:
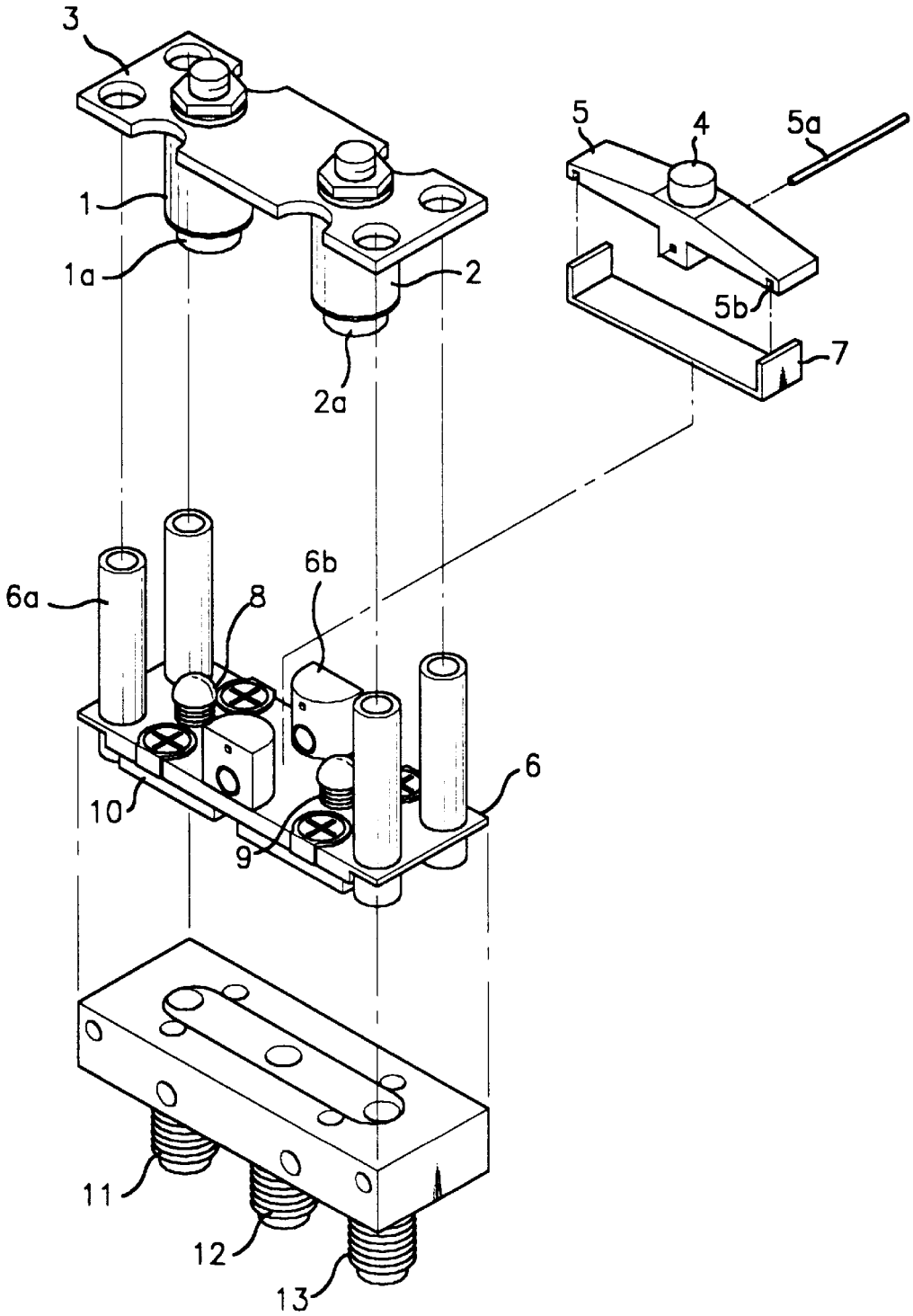
FIG. 3 is a disassembled perspective view showing the first embodiment of a switch with a rocker according to the present invention.

As shown in FIG. 3, the switch of first embodiment according to the present invention has a supporting plate 3, with a through hole in each corner thereof. A base-cover 6 is located under the supporting plate 3. Three connectors 11 to 13 are located under the base-cover 6. The present invention also has a rocker 5, which is made of a metal that can be magnetized and disposed on the base-cover 6. In this case, the rocker 5 has a permanently affixed magnet 4 on the upper and center surface thereof and the rocker 5 is magnetized by the attached magnet 4.

The supporting plate 3 has a first and second solenoids 1 and 2 respectively disposed on both ends of bottom surface thereof. The solenoids 1 and 2 have bobbin cores 1*a* and 2*a* respectively therein, so that the solenoids 1 and 2 can function as an electromagnet when a power is supplied. In this embodiment, when a power is supplied to one of the solenoids, the solenoid has an S pole (South Pole) on the lower portion thereof, in accordance with the Fleming's right-hand rule.

Figure 4:
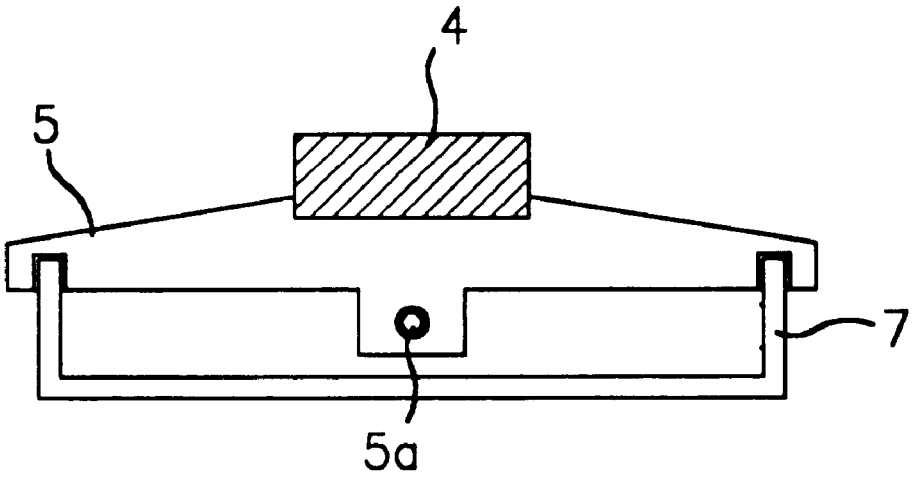
FIG. 4 is a front view showing an assembly of a rocker and a plate spring of FIG. 3.

The base-cover 6 has supporting bars 6a connected to each through hole on the upper portion thereof, and rocker supporting bars 6*b* to support the rocker 5 on both sides of the center portion thereof. Each rocker supporting bar 6*b* has a hole on the upper portion thereof. Therefore, when the rocker 5 is disposed on the base-cover 6, the rocker 5 is supported by a rocker pin 5*a*, which slips into the through hole of the rocker supporting bars 6*b* and the rocker 5(See FIG. 4). This is to ensure that predetermined space is maintained between the rocker 5 and the solenoids 1 and 2.

Figure 5:
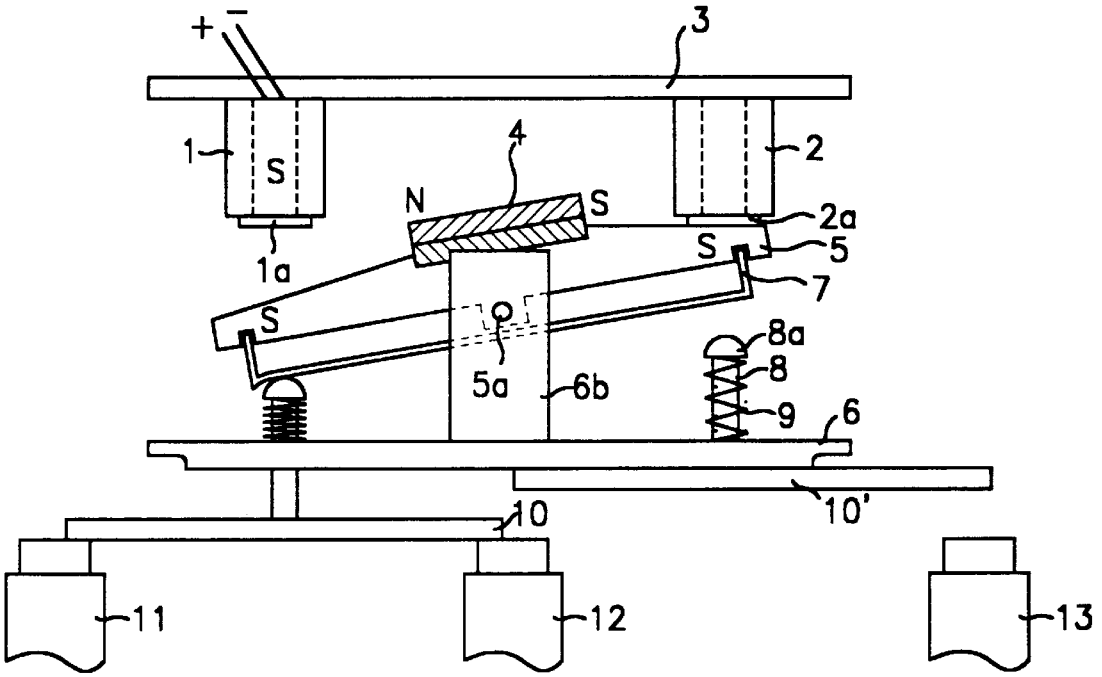
FIG. 5 is a schematic front view showing an operation state of the switch according to the present invention.

In this case, as shown in FIG. 5, the rocker 5 seesaws about the rocker pin 5*a* by a predetermined angle. In the present invention, the rocker 5 is permanently magnetized by the attached magnet 4. When power is supplied to the first solenoid 1, S pole occurs in the lower portion thereof. At this time, since the left portion of the rocker 5 is an S pole, the first solenoid 1 repels the left portion of the rocker 5 downward. Therefore, the right portion of the rocker 5 is contacted with the lower end portion of the second bobbin 2*a*. In this case, the inclined state of the rocker 5 is retained by an attraction occurred between the first solenoid 1 and the permanent magnet 4. That is, when the power is supplied to the first solenoid 1 so that the left side of the rocker 5 is repelled, the permanent magnet 4 is also tilted in the same direction as the left side of the rocker 5. Accordingly, the permanent magnet 4 closes to the first solenoid 1 so that a force for retaining the inclined state of the rocker 5 is increased by the attraction occurred between the first solenoid 1 and the permanent magnet 4. Further, the friction force is significantly reduced between the through hole of the rocker supporting bars 6*b* and the rocker pin 5*a* since the force pulling up the rocker 5 does not exist like the prior art. Therefore, the switching operation can be smoothly performed and the lifecycle of the switch is increased. As a result of a lifecycle test, the switch of the present invention operated over thirteen million times.

The rocker 5 has a substantially Ц-shaped plate spring 7, in which the erect portion of the plate spring 7 is affixed to the slots 5*b* of the rocker 5 by an adhesive or a welding. The base-cover 6 has two dielectric pins 8 inserted at both end portions thereof. When the rocker 5 is tilted, each dielectric pin 8 is pushed by the plate spring 7 in a downward direction of the base-cover 6. In this case, the plate spring 7 is unlikely to be plastic-deformed. The contact areas with the dielectric pin 8, the two erect portions of the plate spring 7, are reinforced by the rocker 5 even though the plate spring 7 pushes the dielectric pin 8 for a long time.

Each dielectric pin 8 is surrounded by a spring 9. The spring 9 provides a restoring force to the dielectric pin 8, so that the dielectric pin 8 returns to its original position when the pressure pushing the dielectric pin 8 is removed. The two dielectric pins 8 have reeds 10 and 10' respectively on the lower end portion thereof. Therefore, when the dielectric pin 8 is pushed by the plate spring 7 in the downward direction, the reed 10 contacts two connectors 11 and 12 or the reed 10' contacts two connectors 12 and 13.

Figure 6:
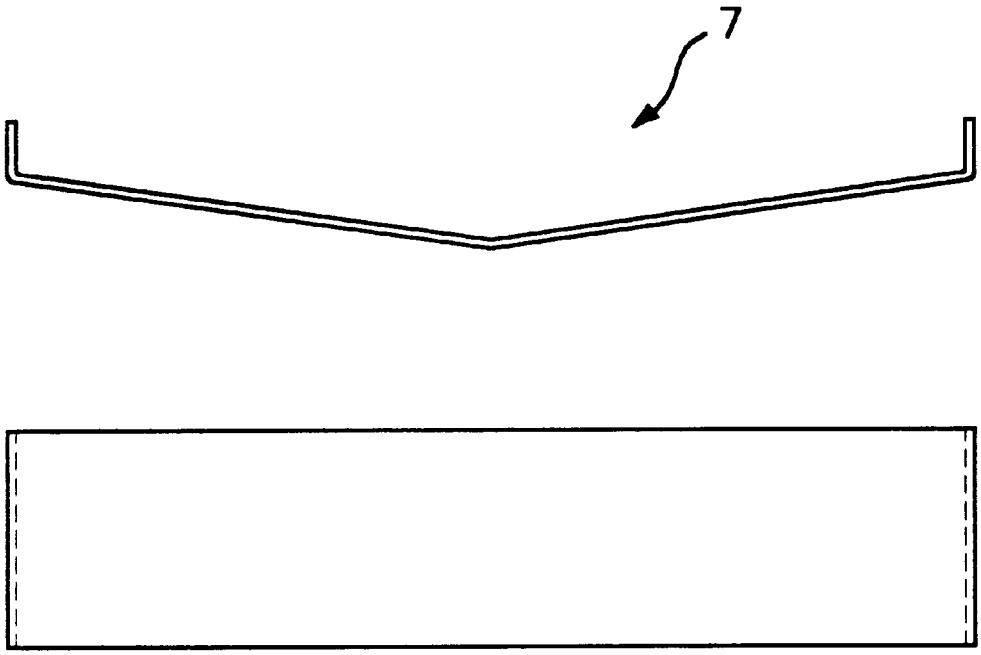
FIG. 6 shows a modified plate spring of the switch with a rocker according to the present invention.

Further, when the plate spring 7 is flat, the plate spring 7 may not press the head of the dielectric pin 8*a*, having a curvature, in the normal direction. Accordingly, this may cause the switch of the present invention not to operate. In order to prevent this case, as shown in FIG. 6, it is preferred that the plate spring 7 is convex in the downward direction. That is, when the plate spring 7 is inclined as the FIG. 6, the plate spring 7 can always press the head of the dielectric pin 8*a* in the normal direction.

In conjunction to the present invention constructed above and as shown in FIG. 5, the following describes how the switch with the magnet rocker is operated.

As show in FIG. 5, when a power is supplied to the first solenoid 1, S pole occurs in the lower portion thereof. At this time, since the left portion of the rocker 5 is an S pole, the first solenoid 1 repels the left portion of the rocker 5 in downward direction and the right portion of the rocker 5 is moved in an upward direction.

In this case, the rocker 5 retains the state inclined in the left direction since the permanent magnet 4 closes to the first solenoid 1, i.e., a large attraction occurs between the first solenoid 1 and the permanent magnet 4. In this case, the plate spring 7 pushes the head of the left dielectric pin 8*a* downward, which makes the reed 10 to contact the connectors 11 and 12.

On the contrary, if an operator supplies the power to the second solenoid 2, the right portion of the rocker 5 is repelled downward and the left portion of the rocker 5 is contacted to the first solenoid 1 by the above mentioned principle. In this case, the inclined state of the rocker 5 is retained by the attraction occurred between the second solenoid 2 and the permanent magnet 4; and the plate spring 7 pushes the head of the right dielectric pin 8a. Therefore, the reed 10' moved along with descent of the dielectric pin 8 is contacted with the connectors 12 and 13.

Hereinafter, the second and the third embodiments of the present invention will be described, referring to FIGS. 7 and 8. In describing the second and the third embodiments, overlapping descriptions with the previous embodiment will be omitted.

Figure 7:
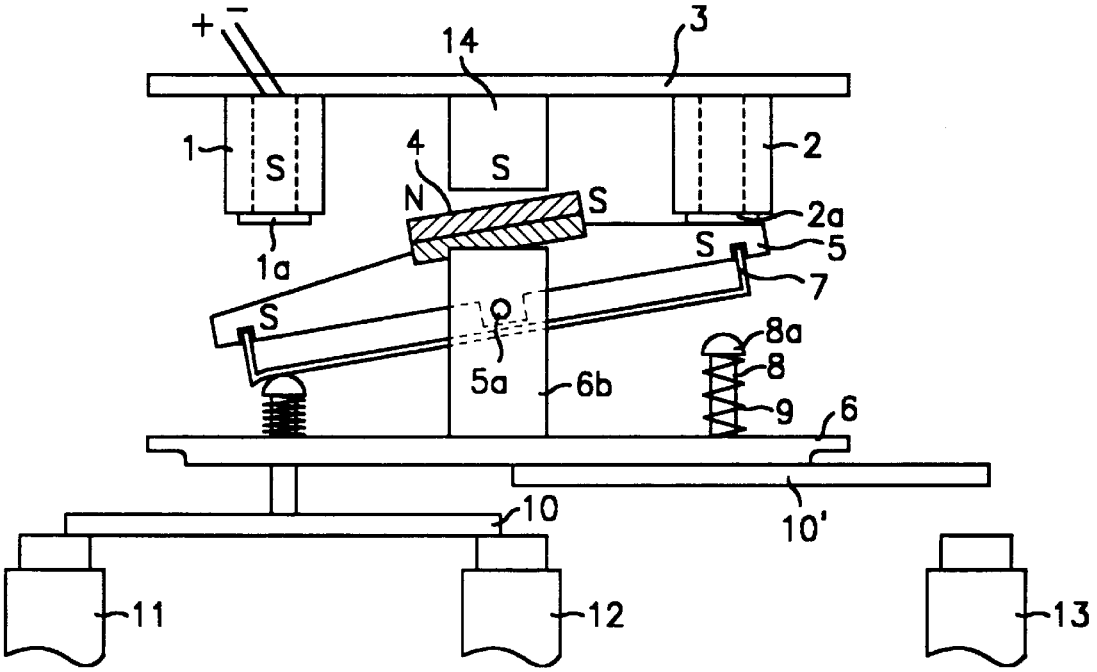
FIG. 7 shows a second embodiment of the switch with a rocker according to the present invention.
Figure 8:
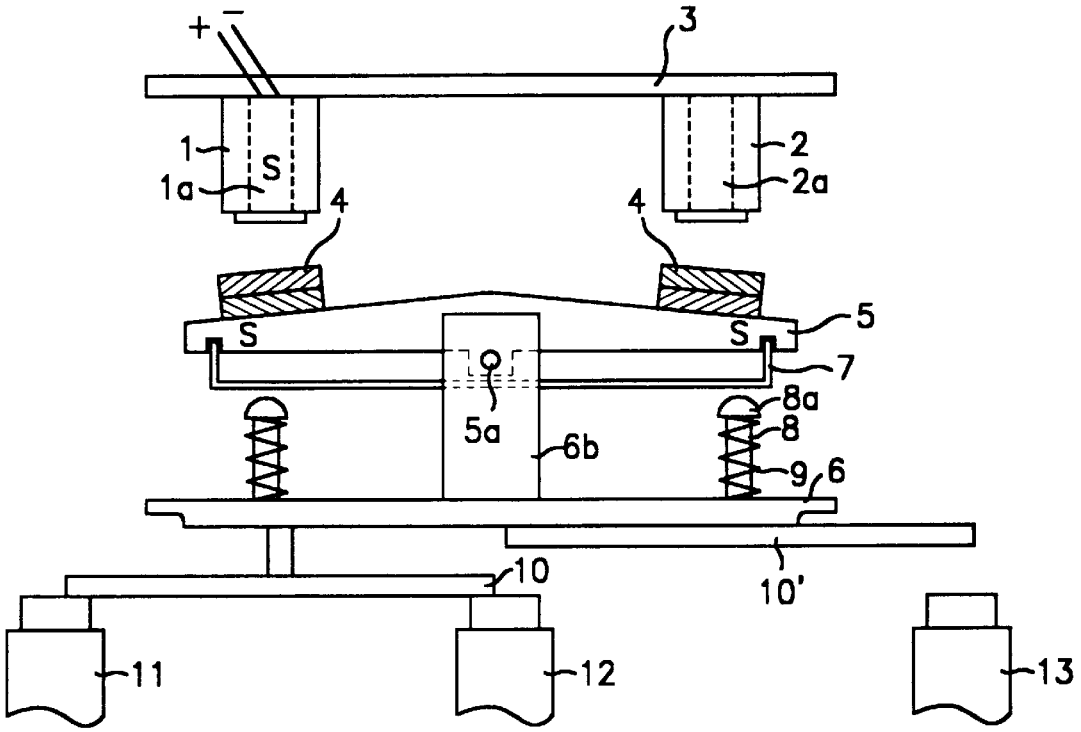
FIG. 8 shows a third embodiment of the switch with a rocker according to the present invention.

As shown in FIG. 7, the second embodiment of the switch comprises of a post 14 disposed between the two solenoids 1 and 2. In this case, when power is supplied to the switch of this embodiment and the rocker 5 is inclined, the post 14 is changed to an electromagnet having an S pole on the lower portion thereof. Therefore, when the rocker 5 is seesawed, the inclined state of the rocker 5 is retained by a resultant force of the attraction occurred between the solenoid 1 or 2 and the permanent magnet 4 and the attraction occurred between the post 14 and the permanent magnet 4.

As the above-mentioned the first and the second embodiments, this invention is not limited to the structure which the rocker 5 is magnetized by the permanent magnet 4 disposed on the upper surface thereof. Therefore, as shown in FIG. 8, in the third embodiment of the present invention, the rocker 5 has two permanent magnets 4 disposed on both end portions of the upper surface thereof in order to be contacted with the each solenoid disposed on the bottom surface of the supporting plate 3. Therefore, when a power is supplied to a solenoid, the repulsion occurring between each solenoid and the rocker is larger than one occurring in the first or the second embodiment. Therefore, the switch of this embodiment can be used in applications where a strong force is required.

In the first to third embodiments, the length of bobbin core, which extends downward of the solenoid, is about 0.5 mm, the attraction between the solenoid and the permanent magnet 4 is weak. The portion of the rocker 5 contacted with the bobbin core is often removed from the bobbin core under vibration greater than six-gravity. Further, when the coil wound around the solenoid has a resistance of 50(Ohms) and a rated voltage of 12 V(Volts), the power consumption of the switch is 2.88 W(Watts) and the pick-up voltage of the switch is 8 V.

Figure 9:
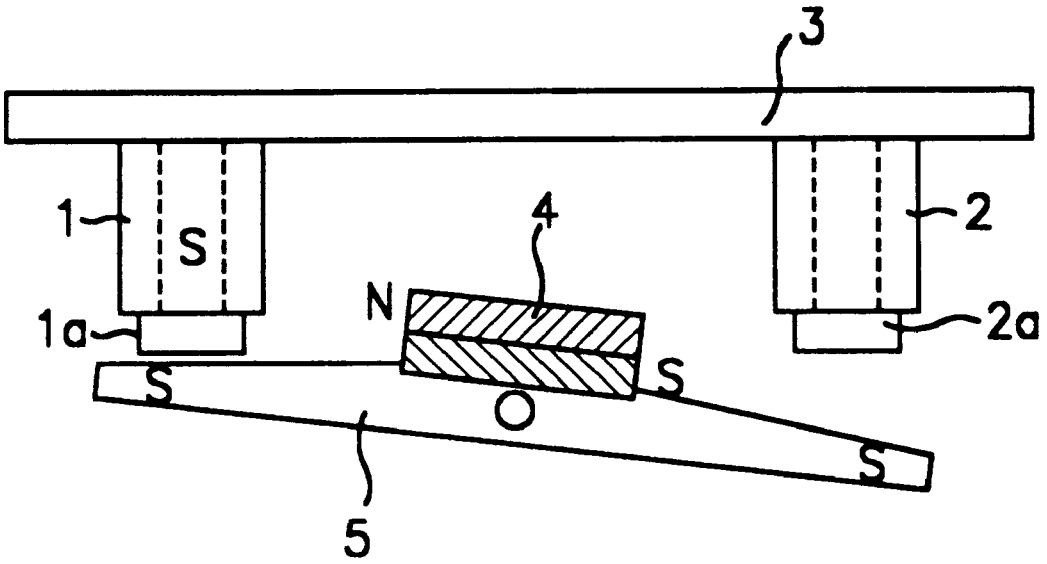
FIG. 9 shows another embodiment of a bobbin core of the switch according to the present invention.

As shown in FIG. 9, it is preferred that the length of bobbin core, which extends downward of the solenoid, is at least 3 mm so that the rocker 5 is firmly contacted with the lower portion of the bobbin core. In this case, the pair-force of the attraction between the solenoid and the permanent magnet and the repulsion between the solenoid and the rocker are stronger compared to the previous embodiments. In this case, since the inclined state of the rocker is more stable, the switch of the present invention operates reliably even under vibration conditions of ten-gravity. Further, when the coil wound around the solenoid has a resistance of 60 (Ohms) and a rated voltage of 12 V, the power consumption of the switch is 2.4 W and the pick-up voltage is 4 V. Accordingly, the switch has lower power consumption and lower pick-up voltage compared with the previous switch. Furthermore, since this switch can operated under the vibration at ten-gravity, the switch of the present invention can be used for the military and space applications.

A switch, according to the present invention comprising and operating as above-mentioned, can reliably accomplish the followings:

1) The necessary friction force is minimized during the switching operation and thereby increasing the reliability with lower power consumption; and 2) The lifecycle is extended by preventing plastic deformation and be retained stable contact between the plate spring and the dielectric pin.

It should be understood that the present invention is not limited to the particular embodiments disclosed herein as the best mode contemplated for carrying out the present invention, and are not limited to the specific embodiments described in this specification except as defined in the appended claims.

What is claimed is:

1. A switch comprising:

a supporting plate;

a plurality of electromagnets occurring a magnetic force when a power is supplied thereto, and being disposed on a bottom surface of said supporting plate;

a rocker made of a metal that can be magnetized to occur a repulsion with said electromagnet, and being seesawed by a predetermined angle;

at least one magnetization means for magnetizing said rocker and retaining an inclined state of said rocker by occurring an attraction with one of said electromagnet, and being disposed on said rocker;

a pressing means, for providing a pressure along with rotation of said rocker, having erect portion on both end portions thereof, in which said erect portions are fixed to said rocker; and a contact means being contacted with connectors by said pressure of said pressing means.

2. The switch according to claim 1, further comprises a means for developing magnetic field occurring an attraction with said magnetization means in order to retain said inclined state of said rocker.

3. The switch according to claim 1, wherein said magnetization means consists of at least one permanent magnet disposed on position faced with said electromagnets.

4. The switch according to claim 1, wherein said contact means includes a plurality of dielectric members, pushed by said pressure provided from said pressing means, and a plurality of reeds disposed on lower end portion of said each dielectric member in order to be contacted with connectors along with descent of said dielectric members.

5. The switch according to claim 4, said contact means further comprises springs to provide a restoring force to each of said dielectric member, wherein said dielectric member is restored into its original position by said restoring force of said spring when said pressure pushing said dielectric member is removed.

6. The switch according to claim 1, wherein each of said electromagnet comprises a soleonid and a bobbin core inserted into said solenoid, wherein a lower portion of said bobbin core is extended downward of said solenoid by a predetermined length.

7. The switch according to claim 6, wherein a length of said bobbin core extended downward of said solenoid is about 3 mm.

8. The switch according to claim 1, wherein said pressing means is convex in a downward direction.

9. The switch according to claim 8, wherein both side portions of bottom member of said pressing means have a predetermined inclination respectively, wherein said pressing means pushes said contact means in a substantially normal direction.

* * * * *